US005449296A

United States Patent [19]

Jacobsen et al.

[11] Patent Number: 5,449,296

[45] Date of Patent: Sep. 12, 1995

[54] CABLE CONNECTOR APPARATUS FOR PREVENTING RADIATION LEAKAGE

[75] Inventors: Ingolf G. Jacobsen, Phoenix; John R. Snowberger, Peoria, both of Ariz.

[73] Assignee: Cabel-Con, Inc. USA, AN AZ Corporation, Phoenix, Ariz.

[21] Appl. No.: 206,661

[22] Filed: Mar. 7, 1994

[51] Int. Cl.[6] ..... H01R 13/622

[52] U.S. Cl. ..... 439/322; 174/35 C

[58] Field of Search ..... 439/320–323, 439/578, 607; 174/35 C

[56] References Cited

U.S. PATENT DOCUMENTS 2,759,040 8/1956 Knudson ..... 174/35 C 4,786,757 11/1988 Owensby et al. ..... 174/35 C

*Primary Examiner*—Neil Abrams

*Attorney, Agent, or Firm*—H. Gordon Shields

[57] ABSTRACT

Connector apparatus for connecting coaxial cable elements includes a primary connector body and connector elements for securing coaxial cable to the main connector body. The connector elements, in addition to the main connector body, include a lock ring, an inner connector element or nut held onto the connector body by the lock ring, and an outer rotating nut disposed on the inner nut and the rotation of which causes the rotation of the inner nut. The inner nut is rotated by the outer nut until metal to metal contact is made between the outer nut and the connector body and also between the outer nut and the coaxial cable element to prevent radiation leakage from the coaxial cable elements.

14 Claims, 2 Drawing Sheets

CABLE CONNECTOR APPARATUS FOR PREVENTING RADIATION LEAKAGE

BACKGROUND OF THE INVENTION

1. Field of the Invention

This invention relates to connector apparatus and, more particularly, to apparatus for connecting coaxial cable, such as used in the cable television industry.

2. Description of the Prior Art

In the cable television industry, there is a need to connect coaxial cables, and the prior art connector elements invariably do not make appropriate metal to metal contact to prevent radiation leakage. That is, there is typically a leakage of radiation at the connector elements. Radiation leakage is an undesirable characteristic and, is monitored in a CATV system under F.C.C. regulations, so as to insure minimum radiation.

The apparatus of the present invention makes metal to metal contact between the elements involved and accordingly substantially eliminates radiation leakage.

SUMMARY OF THE INVENTION

The invention described and claimed herein comprises connector apparatus for connecting, specifically, coaxial cable elements and metal to metal contact is provided to substantially eliminate radiation leakage. The metal to metal contact is effected using a double lock ring system, with an outer connector ring that essentially floats on the inner connector element to insure metal to metal contact.

While the connector apparatus is illustrated in conjunction with coaxial cable as the use environment, and radiation is the flowing entity, the apparatus of the present invention is applicable to virtually any flowing entity, whether it be radiation, fluid, or the like.

Among the objects of the present invention are the following:

To provide new and useful connector apparatus having an inner connector element and an outer connector element floating on the inner connector element.

To provide new and useful connector apparatus;

To provide new and useful connector apparatus for coaxial cable;

To provide new and useful connector apparatus in which metal to metal contact is provided between the elements being connected to prevent radiation leakage;

To provide new and useful connective apparatus for connecting threaded elements in a leak-tight manner.

DESCRIPTION OF THE PREFERRED EMBODIMENT

Figure 1:
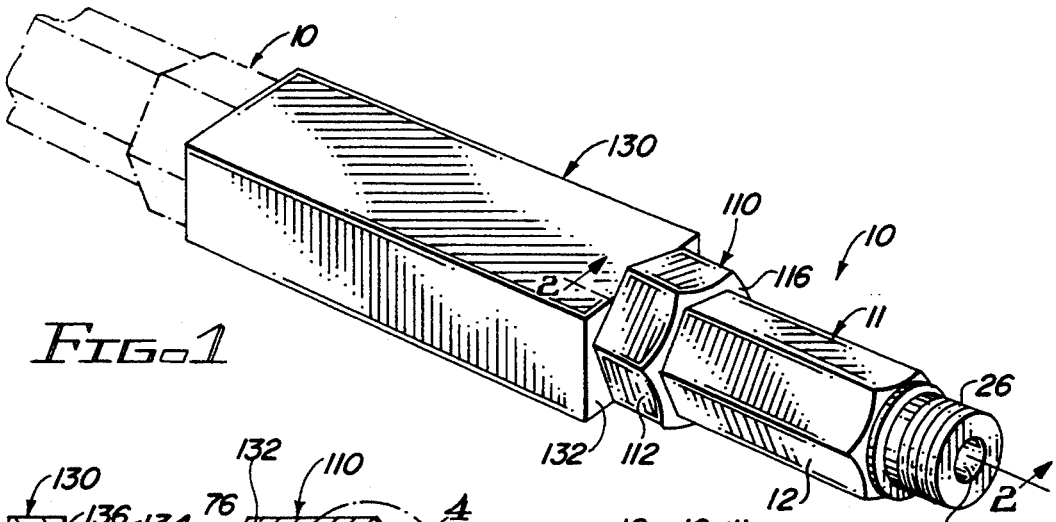
FIG. 1 is a perspective view of the apparatus of the present invention in a use environment.

FIG. 1 is a perspective of connector apparatus 10 of the present invention shown connected to a block 130. At the opposite end of the block 130, there is a second connector apparatus 10 indicated in dash dot line.

Figure 2:
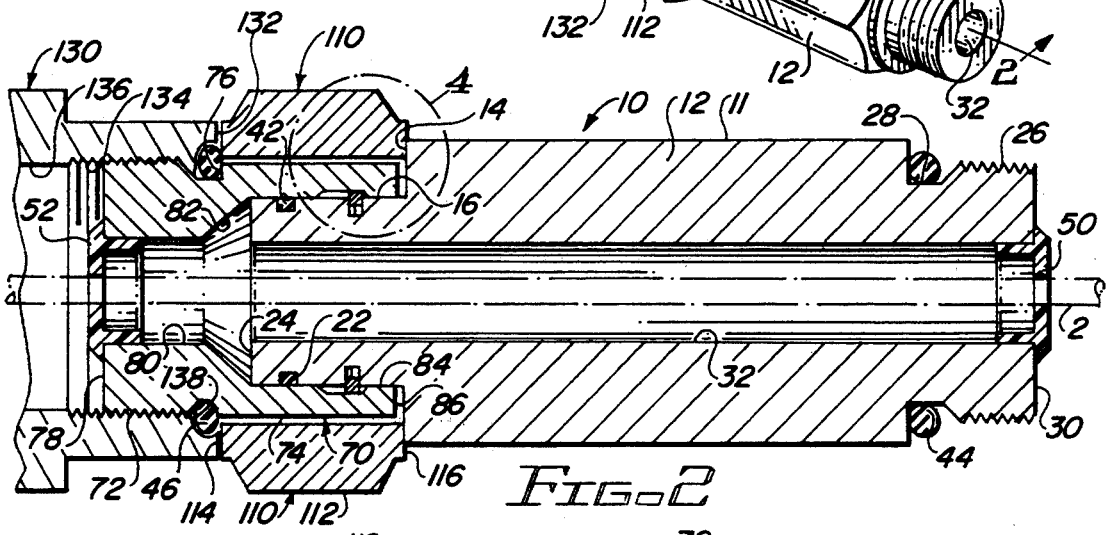
FIG. 2 is a view in partial section taken generally along line 2—2 of FIG. 1.
Figure 3:
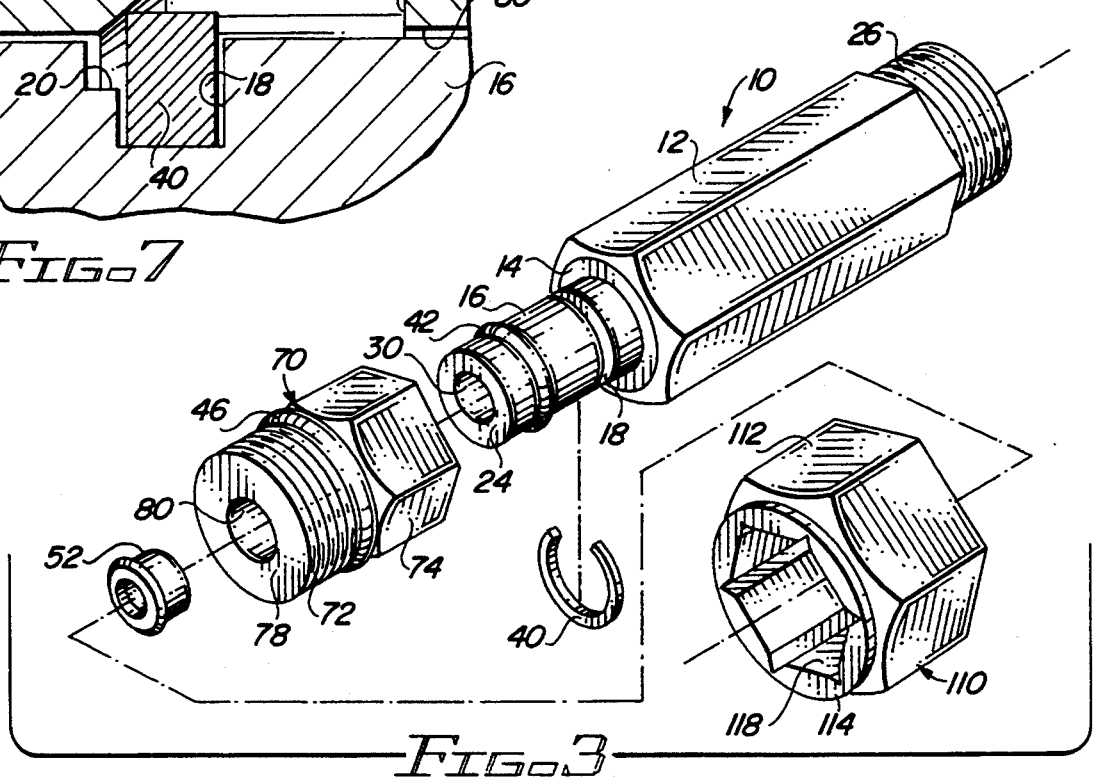
FIG. 3 is an exploded perspective view of the apparatus of the present invention.

FIG. 2 is a view in partial section taken generally along line 2—2 of FIG. 1 through the connector apparatus 10 and through an adjacent portion of the block 130. FIG. 3 is an exploded perspective view of the connector apparatus 10 of the present invention. For the following discussion, reference will primarily be made to FIGS. 1, 2, and 3.

The connector apparatus 10 includes a body 11 having two portions, a generally hexagonally shaped body portion 12 and a cylindrical body portion 16. A bore 32 extends axially through the body 11. The bore 32 is longitudinally extending, and in FIG. 2 there is shown in dash dot line a center conductor 2.

The hex shaped body 12 includes a front shoulder 14. The shoulder 14 comprises a transition area between the hex shaped body portion 12 and a front cylindrical portion 16.

The front cylindrical portion 16 includes a lock ring groove 18 and an O ring groove 22. An O ring 42 is shown in FIGS. 2 and 3 disposed in the O ring groove 22.

The front cylindrical portion 16 terminates in a front end or front face 24. The front face 24 is substantially perpendicular to the longitudinal axis of the connector apparatus 10 and to the bore 32 which extends through the apparatus 10.

At the rear of the hex shaped body portion 12 is a threaded portion 26. The threaded portion 26 is externally threaded for connection to an appropriate element. An O ring groove 28 is disposed between the hex shaped body 12 and the rear threaded portion 26. An O ring 44 is shown in FIG. 2 disposed in the O ring groove 28. The rear portion 26 terminates in a rear end 30.

In FIG. 2, a seal and insulator element 50 is shown extending into the bore 32 from the rear end face 30. The element 50 is, of course, made of nonconductive material. The center conductor 2 extends through the element 50.

Disposed on the front cylindrical portion 16 is an inner lock element or inner nut 70. The inner lock element 70 includes a front or forward externally threaded portion 72 and a rear noncircular, hexagonally shaped portion 74. An O ring groove 76 is disposed at the juncture of the front threaded portion 72 and the rear hex portion 74. An O ring 46 is shown in FIGS. 2 and 3 disposed in the O ring groove 76.

The front externally threaded portion 72 includes a front end face 78. The end face 78 is generally perpendicular to the longitudinal axis of a pair of bores which extend through the inner lock element 70. The bores include a front bore 80 and a rear bore 84. The bores 80 and 84 are best shown in FIG. 2. Between the bores 80 and 84 is a sloping portion 82.

The diameter of the bore 84 is greater than the diameter of the bore 80. The sloping portion 82 comprises a transition area between the two bores. The bore 84 receives the cylindrical portion 16 of the body 11, as shown in FIG. 2.

At the rear of the inner lock element 70 is a rear end face 86. The end faces 78 and 86 are generally parallel to each other, and both are generally perpendicular to the bores 80 and 84.

A lock ring groove 90 extends into the inner lock element 70 from the rear bore 84. Details of the lock ring groove 90 are illustrated in FIGS. 3, 4, 5, 6, and 7. The lock ring groove 90 cooperates with the lock ring groove 18 on the front cylindrical portion 16 of the body 12. For the following discussion of the grooves 18 and 90, reference will primarily be made to FIGS. 4, 5, 6, and 7.

Figure 4:
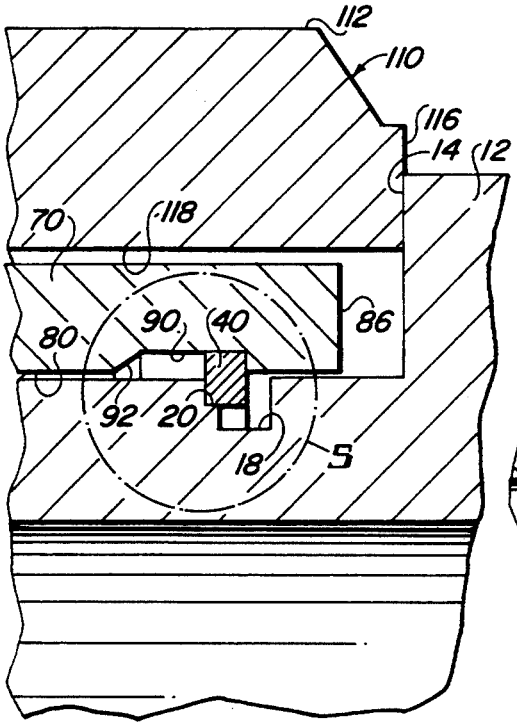
FIG. 4 is an enlarged view in partial section taken generally from Circle 4 of FIG. 2.
Figure 5:
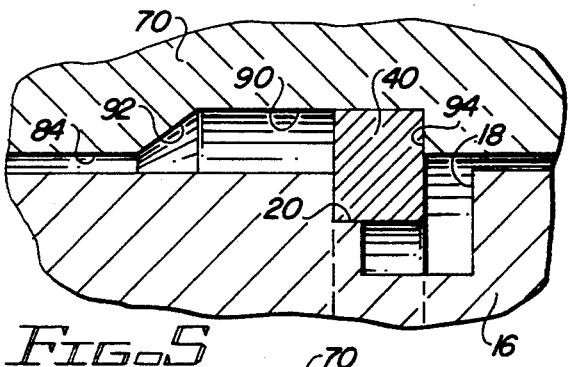
FIG. 5 is an enlarged view in partial section taken generally from Circle 5 of FIG. 4.
Figure 6:
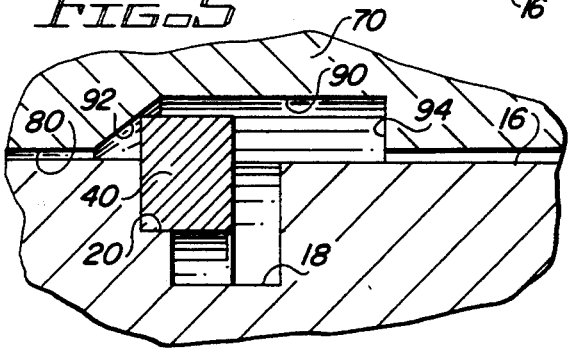
FIGS. 6 and 7 are enlarged views in partial section illustrating the consecutive operations involved with portions of the apparatus of the present invention.
Figure 7:
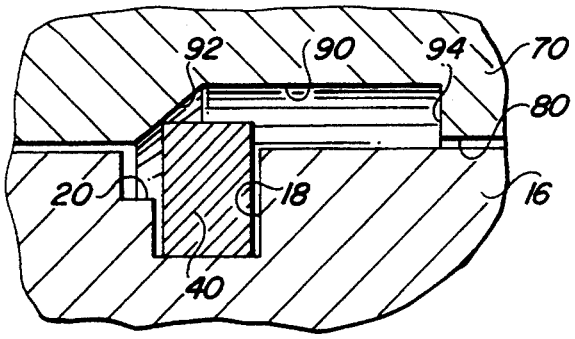

FIG. 4 is an enlarged view in partial section taken generally from circle 4 of FIG. 2, showing a lock ring 40 relative to the grooves 18 and 90. FIG. 5 is an enlarged view in partial section taken generally from Circle 5 of FIG. 4, showing the lock ring 40 as it is seated in the grooves 18 and 90. FIGS. 6 and 7 are sequential views illustrating the seating and employment of the lock ring 40.

It will be noted that the lock ring groove 18 in the cylindrical portion 16 includes a step or shoulder 20. The step or shoulder 20 is on the front portion of the groove 18. The step or shoulder 20 is circumferentially extending in or on the groove 18.

The groove 90 includes a sloping portion 92 which comprises a cam surface transitioning between the bore 80 and the main portion of the groove 90.

At the rear end of the groove 90 is a shoulder 94. The shoulder 94 extends between the groove 90 and the bore 84. The shoulder 94 is substantially perpendicular to the longitudinal axis of the bore 84, and it is also substantially perpendicular to the axis of the groove 90. The longitudinal axis of the groove 90 is, of course, the same as the longitudinal axis of the bore 84.

The lock ring 40 is shown spaced apart from the cylindrical portion 16 and the groove 18 in FIG. 3. The lock ring 40 is, of course, split, so as to be placed in the groove 18 and allow the lock ring to be compressed by the cam surface 92, as shown in FIG. 6.

As the inner lock element 70 is moved rearwardly on the front cylindrical portion 16, the lock ring 40 is squeezed or compressed circumferentially to allow it to move into the groove 18 as the rear end face 86 of the inner lock element 70 moves over the groove 18 and accordingly over the lock ring 40. To insure that the lock ring 40 is disposed within the groove 18, the sloping surface 92 acts as a cam as the inner lock element 70 is moved rearwardly relative to the front cylindrical portion 16. The lock ring 40 is then seated within the groove 18. This is shown in FIG. 7.

With the lock ring 40 seated in the groove 18, the inner lock element or nut 70 is secured to the forward cylindrical portion 16 of the body 11. In the groove 18, the ring 40 expands to the diameter of the groove 90 as the inner element 70 moves forwardly, or to the left from the position shown in FIG. 7 sequentially to the positions shown in FIGS. 6 and 5. The inner diameter of the ring 40 is then about the same as the outer diameter of the shoulder 20.

As the inner lock element 70 moves forwardly as it extends into an internally threaded bore, such as when the connector apparatus 10 is secured to a block 130, the lock ring 40 expands radially outwardly into the groove 90. The expanded lock ring 40 then moves onto the step or shoulder 20 when it is moved or cammed forwardly by contact with the rear face 94 of the groove 90. This is as shown in FIG. 5, and also as shown in FIG. 4.

The purpose of the lock ring 40 is, of course, to lock or secure the inner lock element 70 to or on the cylindrical portion 16 of the connector body. Once disposed within the grooves 18 and 90, the locking purpose is accomplished.

Figure 8:
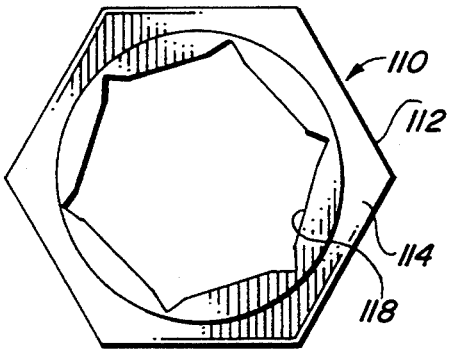
FIG. 8 is an end view of a portion of the apparatus of the present invention.

Disposed about the inner lock element 70 is an outer lock element or outer lock nut 110. FIG. 8 comprises a front view of the outer lock element 110. For the following discussion of the outer lock element 110, reference will be made to FIG. 8, along with FIGS. 1, 2, and 3.

The outer lock element 110 has an outer noncircular, but preferably hexagonal configuration 112. The lock element 110 includes a front face 114 and a rear face 116. The faces 114 and 116 are generally parallel to each other and are generally perpendicular to the longitudinal axis of an inner bore 118.

The bore 118 has a noncircular configuration which matches the noncircular outer configuration of the inner lock element 70, which is preferably hexagonal. The bore 118 is accordingly hexagonal (hex).

The hex bore 118 fits over the rear hexagonal portion 74 of the inner lock element 70. That is, the bore 118 is dimensioned to fit over the hex portion 74 of the inner lock element or member 70 in a rather close fitting, but not tight, relationship. The outer lock element 110 is tied to the inner lock element 70 such that rotation of the outer lock element 110 causes rotation of the inner lock element 70. The joint rotation of the elements 110 and 70 does not interfere with their relative longitudinal movement, as will be discussed below. This relative longitudinal movement is best shown in FIG. 2, and may be understood from FIG. 1.

For purposes of illustrating the operation and structural functioning of the outer connector apparatus 110, some details of the block 130 to which the connector apparatus 10 is secured are shown best in FIG. 2.

The block 130 includes a front face 132 which is generally perpendicular to the longitudinal axis of a pair of coaxial bores 134 and 136. The bore 134 is a front, internally threaded bore. It extends rearwardly from the front face 132. The bore 136 extends rearwardly from the front internally threaded bore 134.

The center conductor 2 is shown in FIG. 2 extending through the bore 136 of the block 130. From the coaxial bores 32, 80, and 82. It will be noted also that FIG. 2 shows a front nonconductive seal and insulator element 52 disposed in the bore 80 of the inner lock element 70. The conductor 2 also extends through the element 52. It will be further noted that the elements 50 and 52 are substantially identical to each other, since the diameter of the bore 80 is substantially the same as the diameter of the bore 32.

The operation of the inner lock element 70, the outer lock element 110, and the body 11 with respect to the block 130 may best be understood from FIG. 2. For the following discussion, reference will primarily be made to FIG. 2.

The connector apparatus 10 is secured to the block 130 through the inner lock element 70. The exterior threaded portion 72 of the inner lock element 70 extends into the internally threaded bore 134 of the block 130. The coupling of the threaded portions is accomplished by rotation of the outer lock element 110.

It will be noted, as indicated above, that the inner lock element 70 is secured to the body 11 through the lock ring 40. Accordingly, securing the inner lock element to the block 130 also secures the body 11 to the block 130. This is shown in FIGS. 4 and 5.

The use of the outer lock element 110 provides a positive electrical connection between the body 11 and the block 130 through direct contact between the rear face 116 of the outer lock element 110 with the front shoulder 14 of the body 12, and direct contact between the front face 114 of the outer lock element 110 and the rear face 132 of the block 130.

The positive contacts between the two faces 114 and 116 of the outer lock element 110 and the shoulder 14 and face 132 is accomplished by continued rotation of the outer lock element 110 until the positive contacts are made. While the outer lock element 110 is being rotated, the inner lock element 70 moves into the threaded bore 134, which bore 134 is longer than the front threaded portion 172 of the inner lock element 70.

As the inner lock element 70 moves forwardly under the rotation of the outer lock element 110, the outer lock element 110 moves rearwardly relative to the inner lock element 70 until positive contact is made by the front and rear faces of the outer lock element 110 and the rear face 132 of the block 130 and the front shoulder 14 of the body portion 12. Thus, positive electrical contact or connection is made between the body 11 and the block 130 which prevents the escape of radiation from the connectors.

It will be noted that there is an O ring groove 138 between the front face 132 of the block 130 and the internally threaded bore 134. The groove 138 receives the O ring 136 which is also disposed in the O ring groove 76 between the hexagonally threaded portion 72 of the inner lock element 74 and the rear hexagonally portion 74 of the element 70. This also provides a positive moisture seal between the two elements.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What we claim is:

1. Connector apparatus for connecting two elements together comprising in combination:

first element means having an internally threaded bore and an end face;

second element means to be connected to the first element, including a first portion, a second portion having a generally cylindrical configuration, a shoulder between the first and second portions, inner nut means disposed on the second portion, including an internal bore for receiving the second portion of the second element means, an externally threaded portion for matingly engaging the internally threaded bore of the first element means, and a noncircular external surface;

means for securing the second element means and the inner nut means together for joint movement; and outer nut means disposed on the inner nut means, including a bore having noncircular internal configuration for matingly receiving the noncircular surface of the inner nut means, a first end face for engaging the end face of the first element means, a second end face for engaging the shoulder of the second element means;

whereby rotation of the outer nut means causes rotation of the inner nut means to move the second element means and the inner nut means relative to the outer nut means by moving the externally threaded portion of the inner nut means into the internally threaded bore of the first element to provide contact between the first and second end faces of the outer nut means and the end face of the first element means and the shoulder of the second element means, respectively.

2. The apparatus of claim 1 in which the means for securing the second element means to the inner nut means includes a lock ring.

3. The apparatus of claim 2 in which the means for securing the second element means to the inner nut means further includes a circumferentially extending groove on the second portion of the second element means and a circumferentially extending groove in the internal bore of the inner nut means, and the lock ring is disposed in the grooves to secure the second element means and the inner nut means together.

4. The apparatus of claim 3 in which the second element means further includes a step in the circumferentially extending bore, and the lock ring is disposed on the step.

5. The apparatus of claim 1 in which the noncircular external surface of the inner nut means comprises a generally hexagonal configuration, and the noncircular internal configuration of the outer nut means comprises a generally hexagonal configuration for matingly engaging the generally hexagonal configuration of the inner nut means.

6. Connector apparatus for connecting a connector body to an element having an internally threaded bore and an end face adjacent to the internally threaded bore comprising in combination:

connector body means having a first portion and a second portion and a shoulder between the first and second portions;

inner nut means, including a bore for receiving the first portion of the connector body means, an externally threaded portion to be matingly engaged with the internally threaded bore of the element, and an outer surface having a noncircular configuration;

means for securing the connector body means to the inner nut means; and outer nut means, including a first end face for contacting the shoulder of the connector body means, a second end face for contacting the end face of the element, and a bore for receiving the inner nut means and having an inner surface to matingly engage the noncircular configuration of the outer surface of the inner nut means, whereby rotation of the outer nut means rotates the inner nut means to move the inner nut means into the internally threaded bore of the element until the first and second end faces of the outer nut contact the shoulder of the connector body means and the end face of the element, respectively.

7. The apparatus of claim 6 in which the means for securing the connector body means to the inner nut means includes a lock ring.

8. The apparatus of claim 7 in which the means for securing the connector body means to the inner nut means further includes a first groove in the bore of the inner nut means and a second groove on the first portion of the connector body means, and the lock ring is disposed in the first and second grooves.

9. The apparatus of claim 8 in which the means for securing the connector body means to the inner nut means further includes a step on the second groove on the first portion of the connector body means on which the lock ring is disposed.

10. The apparatus of claim 9 in which the first groove in the bore of the inner nut means includes a sloping cam portion for camming the lock ring into the second groove of the connector body means.

11. the apparatus of claim 10 in which the first groove in the bore of the inner nut means further includes a rear shoulder against which the lock ring abuts for moving the connector body means and the inner nut means as the outer nut means is rotated.

12. The apparatus of claim 6 in which the noncircular configurations of the outer surface of the inner nut means and the inner surface of the outer nut means are hexagonal.

13. The apparatus of claim 6 in which the connector body means includes a bore extending through the first and second portions, and the bore is aligned with the bore in the inner nut means.

14. The apparatus of claim 13 in which the bore in the inner nut means includes a first portion having a first diameter for receiving the first portion of the connector body means, a second portion having a second diameter, which second diameter is less than the first diameter, and a sloping portion extending between the first and second portions.

* * * * *